US008827754B2

(12) United States Patent
Lee et al.

(10) Patent No.: US 8,827,754 B2
(45) Date of Patent: Sep. 9, 2014

(54) CONNECTOR TERMINAL

(75) Inventors: Chul-Sub Lee, Daegu (KR); Jin-Kwang Kim, Gyeongsangnam-Do (KR)

(73) Assignee: Tyco Electronics AMP Korea, Ltd., Kyungsbank-do (KR)

( * ) Notice: Subject to any disclaimer, the term of this patent is extended or adjusted under 35 U.S.C. 154(b) by 0 days.

(21) Appl. No.: 13/469,627

(22) Filed: May 11, 2012

(65) Prior Publication Data

US 2012/0289101 A1 Nov. 15, 2012

Related U.S. Application Data

(63) Continuation of application No. PCT/JP2010/007450, filed on Oct. 28, 2010.

(30) Foreign Application Priority Data

Nov. 11, 2009 (KR) ..... 10-2009-0108574

(51) Int. Cl.
*H01R 13/187* (2006.01)

(52) U.S. Cl.
USPC ..... 439/845; 439/843; 439/847; 439/849

(58) Field of Classification Search
USPC ..... 439/842–858
See application file for complete search history.

(56) References Cited

U.S. PATENT DOCUMENTS 3,713,080 A * 1/1973 Kennedy ..... 439/852
4,472,017 A * 9/1984 Sian ..... 439/872
4,685,886 A 8/1987 Denlinger et al.
4,696,530 A * 9/1987 Vandame ..... 439/266
4,798,545 A * 1/1989 Roy et al. ..... 439/677
4,934,965 A * 6/1990 Buddrus et al. ..... 439/845
5,007,865 A * 4/1991 Jakobeit ..... 439/839
5,046,972 A * 9/1991 Pass ..... 439/751
5,160,279 A 11/1992 Sagawa et al.
5,269,712 A * 12/1993 Denlinger et al. ..... 439/845
5,288,252 A * 2/1994 Steinhardt et al. ..... 439/839
5,342,226 A * 8/1994 Hayes et al. ..... 439/845

(Continued)

FOREIGN PATENT DOCUMENTS

DE 102005033696 A1 * 3/2006
EP 1122832 A2 8/2001

(Continued)

OTHER PUBLICATIONS

PCT International Search Report, International Application No. PCT/KR2010/007450, 3 pages.

(Continued)

*Primary Examiner* — Ross Gushi
(74) *Attorney, Agent, or Firm* — Barley Snyder

(57) ABSTRACT

A connector terminal includes a connection body terminal unit and a coupling terminal unit receiving the connection body terminal unit. The coupling terminal unit having an upper coupling terminal part symmetrically arranged with a lower coupling terminal part. Each of the upper and lower coupling terminal parts includes a fixed end, a free end, and a bent portion. The free end is movable and is positioned opposite the fixed end. The fixed end includes a plurality of contact points. The bent portion is positioned between the fixed end and the movable free end, and is disposed along a front side of each of the upper and lower coupling terminal parts.

11 Claims, 4 Drawing Sheets

(56) References Cited

U.S. PATENT DOCUMENTS

| | | | | | |
|---|---|---|---|---|---|
| 5,344,348 | A * | 9/1994 | Willis et al. | 439/849 |
| 5,362,262 | A * | 11/1994 | Hotea | 439/839 |
| 5,431,576 | A * | 7/1995 | Matthews | 439/247 |
| 5,588,884 | A * | 12/1996 | Rudoy et al. | 439/845 |
| 5,630,738 | A * | 5/1997 | Ito et al. | 439/852 |
| 5,645,459 | A * | 7/1997 | Fitting | 439/857 |
| 5,800,220 | A * | 9/1998 | Feeny et al. | 439/849 |
| 5,827,094 | A * | 10/1998 | Aizawa et al. | 439/857 |
| 5,833,500 | A * | 11/1998 | Mahon et al. | 439/852 |
| 5,863,225 | A * | 1/1999 | Liebich et al. | 439/845 |
| 5,911,605 | A * | 6/1999 | Wooldridge et al. | 439/790 |
| 5,921,821 | A * | 7/1999 | Oka et al. | 439/845 |
| 5,938,485 | A * | 8/1999 | Hotea et al. | 439/839 |
| 5,941,740 | A * | 8/1999 | Neuer et al. | 439/852 |
| 5,951,338 | A * | 9/1999 | Seko et al. | 439/843 |
| 5,975,964 | A * | 11/1999 | Seko et al. | 439/857 |
| 6,039,615 | A * | 3/2000 | Suzuki | 439/849 |
| 6,056,604 | A * | 5/2000 | Roy et al. | 439/845 |
| 6,066,009 | A * | 5/2000 | Yamamoto | 439/852 |
| 6,068,526 | A * | 5/2000 | Nottrott et al. | 439/845 |
| 6,171,155 | B1 * | 1/2001 | Miwa et al. | 439/852 |
| 6,210,240 | B1 * | 4/2001 | Comerci et al. | 439/853 |
| 6,276,960 | B1 * | 8/2001 | Schaefer et al. | 439/522 |
| 6,287,156 | B1 * | 9/2001 | Swan et al. | 439/845 |
| 6,464,547 | B2 * | 10/2002 | Ketelsleger | 439/851 |
| 6,547,608 | B2 * | 4/2003 | Sato et al. | 439/852 |
| 6,565,396 | B2 * | 5/2003 | Saka et al. | 439/843 |
| 6,568,955 | B2 * | 5/2003 | Hotea et al. | 439/495 |
| 6,692,316 | B2 * | 2/2004 | Hsieh et al. | 439/845 |
| 6,872,103 | B1 * | 3/2005 | Flieger et al. | 439/839 |
| 6,899,571 | B1 * | 5/2005 | Koch et al. | 439/843 |
| 7,150,660 | B2 * | 12/2006 | Allgood et al. | 439/845 |
| 7,192,318 | B2 | 3/2007 | Hotea | |
| 7,241,189 | B2 * | 7/2007 | Mohs et al. | 439/845 |
| 7,252,559 | B1 * | 8/2007 | Morello et al. | 439/843 |
| 7,445,529 | B2 * | 11/2008 | Takizawa et al. | 439/845 |
| 7,775,840 | B2 * | 8/2010 | Matsumoto et al. | 439/843 |
| 7,892,050 | B2 * | 2/2011 | Pavlovic et al. | 439/839 |
| 7,985,106 | B2 * | 7/2011 | Sugiyama et al. | 439/852 |
| 7,988,505 | B2 * | 8/2011 | Hotea et al. | 439/852 |
| 8,038,488 | B2 * | 10/2011 | Mukuno | 439/845 |
| 8,128,441 | B2 * | 3/2012 | Mukuno | 439/845 |
| 8,419,486 | B2 * | 4/2013 | Tyler | 439/842 |
| 2001/0014560 | A1 * | 8/2001 | Daugherty et al. | 439/851 |
| 2001/0034167 | A1 * | 10/2001 | Ketelsleger | 439/851 |
| 2001/0036775 | A1 * | 11/2001 | Saitoh | 439/852 |
| 2001/0051472 | A1 * | 12/2001 | Sato et al. | 439/852 |
| 2002/0025732 | A1 * | 2/2002 | Hsieh | 439/845 |
| 2003/0060090 | A1 * | 3/2003 | Allgood et al. | 439/845 |
| 2004/0009714 | A1 * | 1/2004 | Endo et al. | 439/856 |
| 2004/0164471 | A1 | 8/2004 | Hotea et al. | |
| 2006/0014442 | A1 * | 1/2006 | Allgood et al. | 439/843 |
| 2007/0066152 | A1 * | 3/2007 | Mohs et al. | 439/843 |
| 2007/0202744 | A1 | 8/2007 | Duemmel et al. | |
| 2009/0029605 | A1 * | 1/2009 | Matsumoto et al. | 439/843 |
| 2011/0045712 | A1 * | 2/2011 | Mukuno | 439/845 |
| 2012/0108113 | A1 * | 5/2012 | Yamaguchi et al. | 439/842 |
| 2012/0156947 | A1 * | 6/2012 | Tyler | 439/842 |
| 2012/0289101 | A1 * | 11/2012 | Lee et al. | 439/878 |

FOREIGN PATENT DOCUMENTS

| | | | |
|---|---|---|---|
| EP | 1420481 | A1 | 5/2004 |
| JP | 05326109 | A | 12/1993 |
| JP | 11233183 | | 8/1999 |
| KR | 1020080024614 | A | 3/2008 |

OTHER PUBLICATIONS

EP Search Report issued in co-pending EP Application No. 10830124.3, issued Mar. 14, 2013, 7 pages.

* cited by examiner

CONNECTOR TERMINAL

CROSS-REFERENCE TO RELATED APPLICATION

This application is a continuation of PCT International Application No. PCT Application No. PCT/JP2010/007450, dated Oct. 28, 2010, which claims priority under 35 U.S.C. §119 to KR Patent Application No. 10-2009-0108574, dated Nov. 11, 2009.

FIELD OF THE INVENTION

The invention relates to a connector and, more particularly, to a connector terminal having a coupling terminal unit.

BACKGROUND

A hybrid car uses two or more power sources. Generally, the hybrid car uses an engine and an electric motor.

In the hybrid car, the engine is normally used in the suburbs or areas where the hybrid car can be driven at a high speed, and the electric motor, which is efficient, is used in heavy traffic or when driving at low speed for whatever reason. At a stop, the combustion engine does not freely idle, but is instead used to charge a battery. For this reason, the hybrid car exhibits high fuel economy, thereby providing high energy efficiency, and in turn reducing consumption of fossil fuels. Consequently, the hybrid car is in the spotlight as an environment-friendly car in terms of the reduction of energy consumption and environmental protection.

Since the hybrid car is driven by the electric motor as described above, the hybrid car includes a plurality of electrical devices. For this reason, electric connectors are frequently used to connect a plurality of electric wires to the plurality of electrical devices.

The electric connector may include a plurality of electric terminals connected to the electric wires, and a corresponding electric connector has a plurality of electric terminals connected to the electric wires. Consequently, electrical connection between the electric terminals of the electric connectors is achieved upon coupling between the electric terminals of the electric connectors. That is, a contact point is formed between a coupling terminal of a connector and a corresponding connection terminal of another connector to achieve electrical connection between the connectors.

If high electric current is applied to the terminals, however, the electric current flows through a single contact point when the coupling terminal and the connection terminal are electrically connected to each other, with the result that an amount of heat generated from the contact point is increased. If a large amount of heat is generated from the contact point, sparks may occur from the contact point, which may result in an explosion.

SUMMARY

Therefore, the present invention has been made in view of the above problems, and it is an object of the invention, among other objects to provide a connector terminal with two or more contact points.

The connector terminal includes a connection body terminal unit and a coupling terminal unit receiving the connection body terminal unit. The coupling terminal unit having an upper coupling terminal part symmetrically arranged with a lower coupling terminal part. Each of the upper and lower coupling terminal parts includes a fixed end, a free end, and a bent portion. The free end is movable and is positioned opposite the fixed end. The fixed end includes a plurality of contact points. The bent portion is positioned between the fixed end and the movable free end, and is disposed along a front side of each of the upper and lower coupling terminal parts.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

Now, embodiments of the invention will be described in detail with reference to the accompanying drawings. In the following, a detailed description of known functions and configurations incorporated herein will be omitted when it may make the subject matter of the invention rather unclear.

Figure 1:
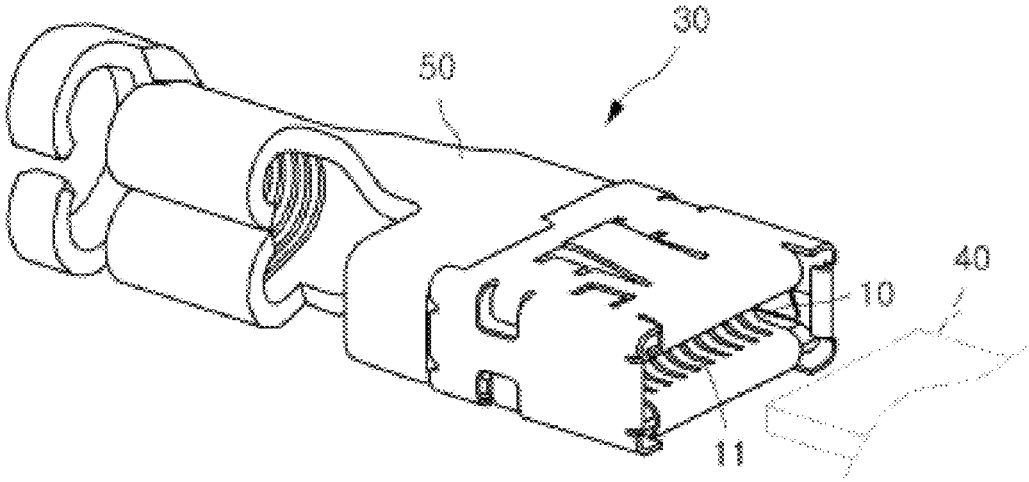
FIG. 1 is a perspective view of a connector terminal having a coupling terminal unit and a connection body terminal unit according to the invention.

As shown in FIG. 1, a connector terminal 30 is configured such that a connection body terminal unit 50 is inserted into one side of a coupling terminal unit 10, which in the embodiment shown is formed in the shape of a pipe open at opposite ends thereof and a connection terminal unit 40 is inserted into the other side of the coupling terminal unit 10 so as to form contact points 15, 16, 17, and 18, and the connection body terminal unit 50 and the connection terminal unit 40 are electrically connected to each other through the coupling terminal unit 10.

Figure 2:
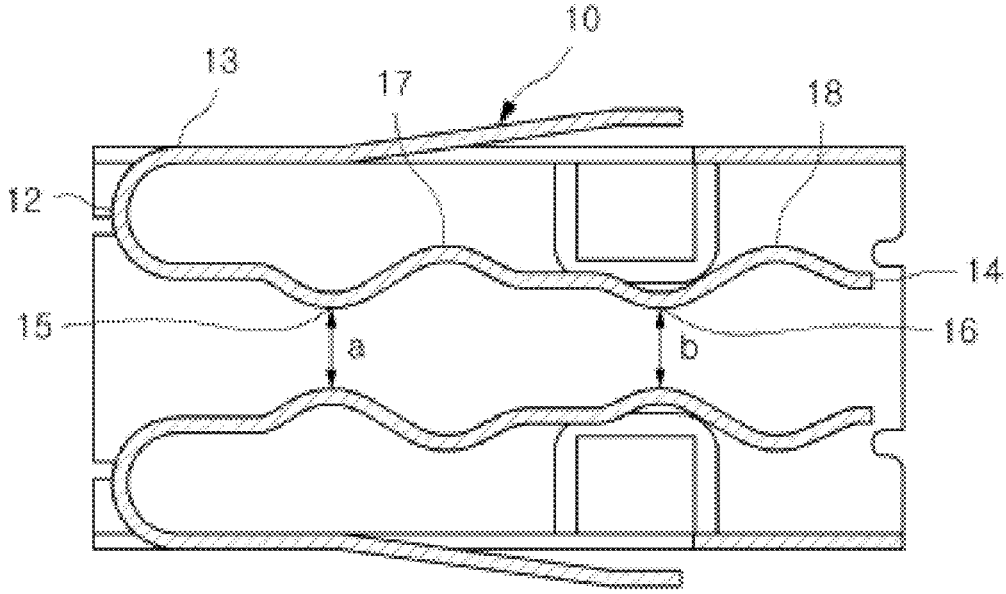
FIG. 2 is a partial section view the coupling terminal unit according to the invention.

Referring to FIG. 2, the coupling terminal unit 10 includes an upper coupling terminal part and a lower coupling terminal part, each of which are made of metal. As previously described, and in the embodiment shown, the coupling terminal unit 10 is formed in the shape of a pipe open at opposite ends thereof. Each of the upper and lower coupling terminal parts is positioned at the front part thereof with a fixed end 13 having a bent portion 12. The upper and lower coupling terminal parts are also positioned at the rear part thereof with a free end 14 which is movable. The upper and lower coupling terminal parts of the coupling terminal unit 10 are arranged in symmetry, as shown.

More specifically, each of the upper and lower coupling terminal parts of the coupling terminal unit 10 is made of a single piece of metal. The metal is bent about the bent portion 12 formed at the front part of each of the upper and lower coupling terminal parts of the coupling terminal unit 10, with the result that the fixed end 13 and the free end 14 are formed while the fixed end 13 and the free end 14 are spaced apart from each other by a predetermined distance corresponding to the bent angle.

In the embodiment shown, the free end 14 of each of the upper and lower coupling terminal parts includes a plurality of slit-shaped grooves 11, by which the coupling terminal unit 10 exhibits elasticity.

The free end 14 of each of the upper and lower coupling terminal parts includes first and second inside contact points 15 and 16 protruding to an inside of the coupling terminal unit 10 and first and second outside contact points 17 and 18 protruding to an outside of the coupling terminal unit 10.

In the embodiment shown, the first and second inside contact points 15 and 16 and the first and second outside contact points 17 and 18 are arranged in zigzags. In other words, the first inside contact point 15 is formed at the free end 14 adjacent to the bent portion 12, and then the first outside contact point 17, the second inside contact point 16, and the second outside contact point 18 are sequentially formed at the free end 14.

In the embodiment shown, the first inside contact points 15 and the second inside contact points 16 are disposed at the upper and lower coupling terminal parts of the coupling terminal unit 10, respectively, such that the first inside contact points 15 and the second inside contact points 16 can come into contact with upper and lower sides of the connection terminal unit 40. The distance (a) between the first inside contact points 15 of the upper and lower coupling terminal parts is equal to the distance (b) between the second inside contact points 16 of the upper and lower coupling terminal parts.

If the distance (b) between the second inside contact points 16 is greater than the distance (a) between the first inside contact points 15, contact between the connection terminal unit 40 and the second inside contact points 16 of the coupling terminal unit 10 may not be achieved when the connection terminal unit 40 is inserted into the coupling terminal unit 10.

On the other hand, if the distance (b) between the second inside contact points 16 is less than the distance (a) between the first inside contact points 15, a greater insertion force may be required to insert the connection terminal unit 40 through a space defined between the first inside contact points 15 than to insert the connection terminal unit 40 through a space defined between the second inside contact points 16 when the connection terminal unit 40 is inserted into the coupling terminal unit 10. Consequently, the connection terminal unit 40 is forcibly inserted into the coupling terminal unit 10 and forcibly removed from the coupling terminal unit 10, which requires greater force. In addition, when the forcible insertion of the connection terminal unit 40 into the coupling terminal unit 10 is repeatedly performed, elastic force of the free ends 14 at which the second inside contact points 16 are formed is gradually decreased, with the result that contact between the connection terminal unit 40 and the second inside contact points 16 of the coupling terminal unit 10 may not be achieved.

The coupling terminal unit 10 electrically connects the connection body terminal unit 50 and the connection terminal unit 40 through the above-described contact points of the coupling terminal unit 10. The connection body terminal unit 50 is positioned into spaces defined between the fixed ends 13 and the corresponding free ends 14 of the coupling terminal unit 10 while the connection terminal unit 40 is inserted into the coupling terminal unit 10 through a space defined between the bent portions 12 of the coupling terminal unit 10.

Contact is achieved between each of the upper and lower coupling terminal parts of the coupling terminal unit 10 and the connection terminal unit 40 at two or more contact points so as to disperse heat generated during electrical connection between the coupling terminal unit 10 and the connection terminal unit 40. In the same manner, contact is achieved between each of the upper and lower coupling terminal parts of the coupling terminal unit 10 and the connection body terminal unit 50 at two or more contact points so as to disperse heat generated during electrical connection between the coupling terminal unit 10 and the connection body terminal unit 50.

Figure 3:
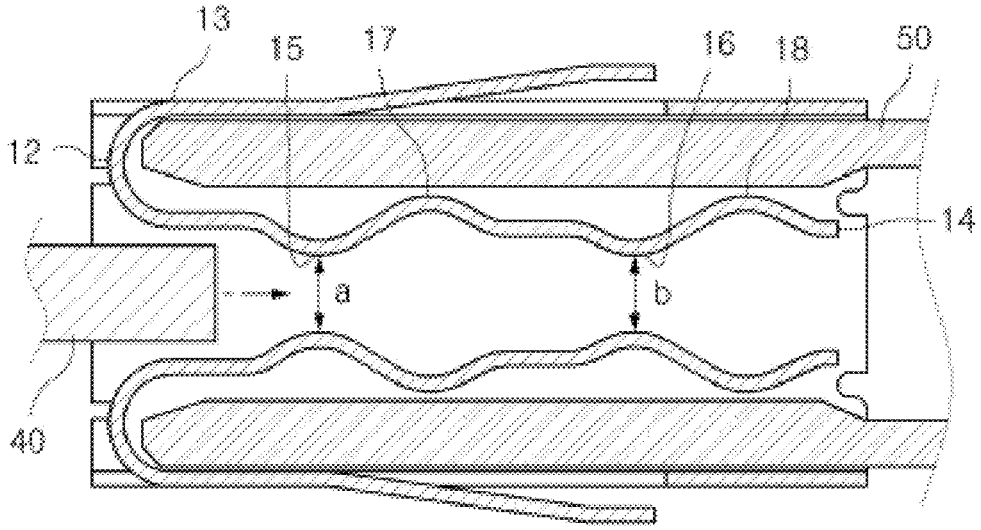
FIG. 3 is a partial sectional view of the coupling terminal unit when the connection body is inserted into the coupling terminal unit.
Figure 4:
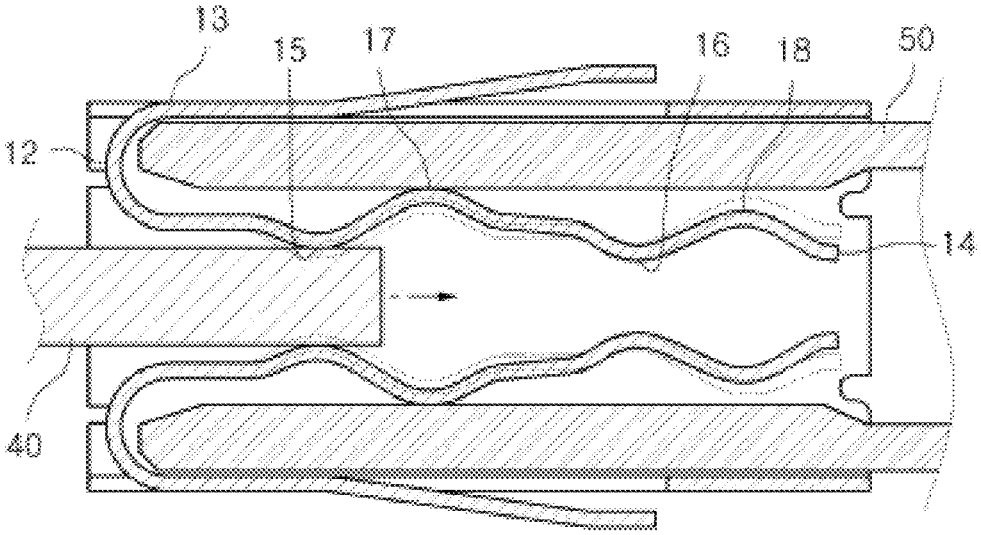
FIG. 4 is a partial sectional view of the coupling terminal when a connection terminal unit is advanced into the coupling terminal unit.
Figure 5:
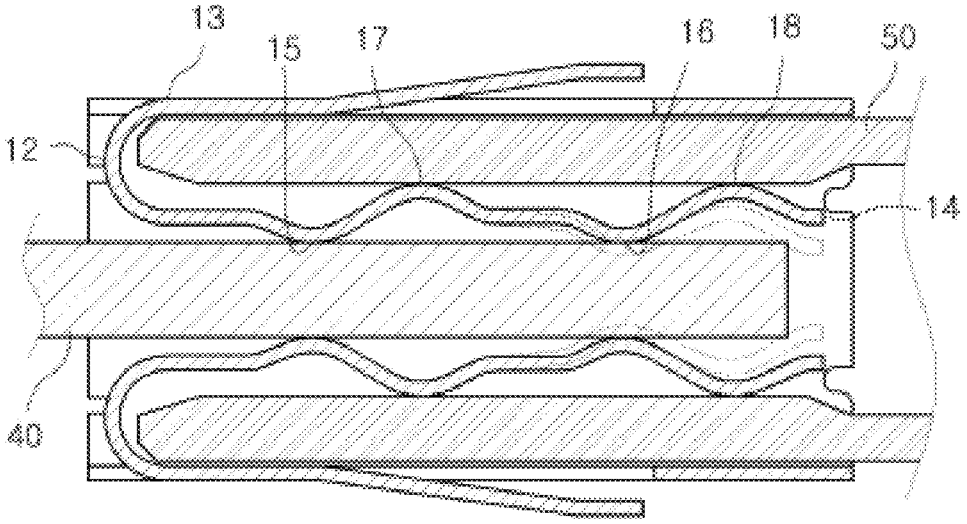
FIG. 5 is a partial sectional view of the coupling terminal unit when the connection body and the connection terminal unit are fitted into the coupling terminal unit.

FIGS. 3, 4, and 5 are sequential illustrations of the electrical connection between the coupling terminal unit 10 and the connection terminal unit 40 and between coupling terminal unit 10 and the connection body terminal unit 50 of the connector terminal 30 according to the invention shown in FIG. 2.

Referring first to FIG. 3, the connection body terminal unit 50 is inserted into the spaces defined between the fixed ends 13 and the corresponding free ends 14 of the coupling terminal unit 10 with the above-stated construction.

Subsequently, the connection terminal unit 40 is inserted into the coupling terminal unit 10 through the space defined between the bent portions 12 of the coupling terminal unit 10. As a result, as shown in FIG. 4, the connection terminal unit 40 comes into contact with the first inside contact points 15. At this time, the connection terminal unit 40 pushes the first inside contact points 15 outward, with the result that the first outside contact points 17 come into contact with the connection body terminal unit 50.

When the first inside contact points 15 and the first outside contact points 17 of the coupling terminal unit 10 come into contact with the connection terminal unit 40 and the connection body terminal unit 50, respectively. The free ends 14, which exhibit elasticity and mobility due to slit-shaped grooves 11, are deformed by a repulsive force generated when the first outside contact points 17 are pushed by the connection terminal unit 40, with the result that the free ends 14 are pushed inward.

For easy description, the operation of the upper connection terminal part of the connection terminal unit 10 will be described in detail as an example. When the connection terminal unit 40 comes into contact with the first inside contact point 15, the connection terminal unit 40 pushes the first inside contact point 15 upward, with the result that the first outside contact point 17 of the coupling terminal unit 10 comes into contact with the connection body terminal unit 50. The repulsive force is generated from the first outside contact point 17 which is pushed upward and comes into contact with the connection body terminal unit 50, and the repulsive force pushes the second inside contact point 16 and the second outside contact point 18 downward.

Referring now to FIG. 5, the connection terminal unit 40 comes into contact with the second inside contact points 16 as the connection terminal unit 40 is further inserted into the coupling terminal unit 10.

At this time, the second outside contact points 18 are pushed outward, with the result that the second outside contact points 18 come into contact with the connection body terminal unit 50.

As described above, the coupling terminal unit 10 is electrically connected to the connection terminal unit 40 and the connection body terminal unit 50 at the first and second inside contact points 15 and 16 and at the first and second outside contact points 17 and 18, respectively. As a result, heat generated during electrical connection between the coupling terminal unit 10 and the connection terminal unit 40 is dispersed through the two contact points between the coupling terminal unit 10 and the connection terminal unit 40. In the same manner, heat generated during electrical connection between the coupling terminal unit 10 and the connection body terminal unit 50 is dispersed through the two contact points between the coupling terminal unit 10 and connection body terminal unit 50.

The number of the first and second inside contact points 15 and 16 and the number of the first and second outside contact points 17 and 18 may be increased based on an amount of heat generated during electrical connection between the coupling terminal unit 10 and the connection terminal unit 40 and between the coupling terminal unit 10 and connection body terminal unit 50.

Figure 6:
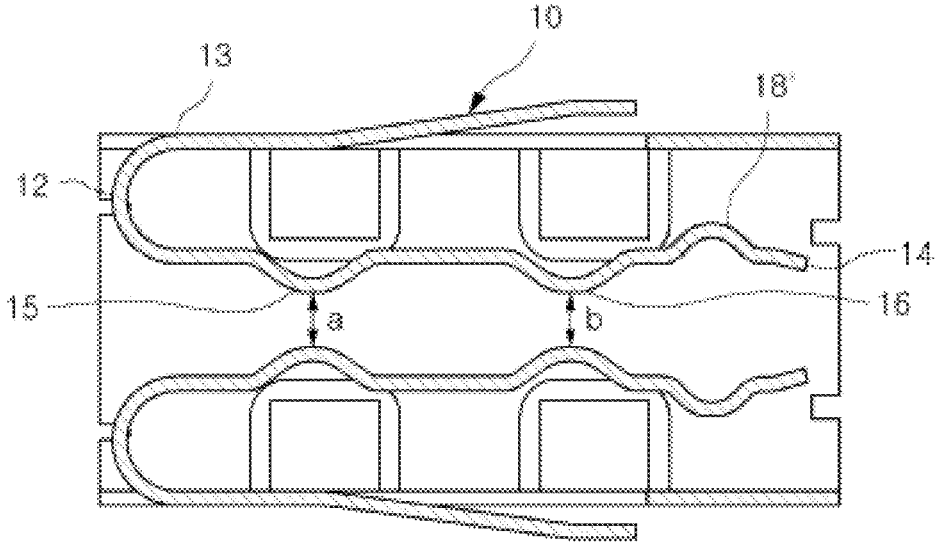
FIG. 6 is a partial sectional view of another coupling terminal unit according to the present invention.

As shown in FIG. 6, another connector terminal 30 is shown, and differs from the previous embodiment shown in FIGS. 1 through 5, in that first and second inside contact points 15 and 16 are formed at a free end 14 of each coupling terminal part in the same manner as in the previous embodiment, but a single outside contact point 18' is formed at the free end 14 of each coupling terminal part such that the single outside contact point 18' comes into contact with a connection body terminal unit 50'. Also, front contact points 51 are formed at front ends of the connection body terminal unit 50', which are inserted into spaces defined between fixed ends 13 and the free ends 14, such that the front contact points 51 protrude inward of the coupling terminal unit 10 (see FIG. 7).

The distance (a) between the first inside contact points 15 of the upper and lower coupling terminal parts of the coupling terminal unit 10 is equal to the distance (b) between the second inside contact points 16 of the upper and lower coupling terminal parts of the coupling terminal unit 10.

Figure 7:
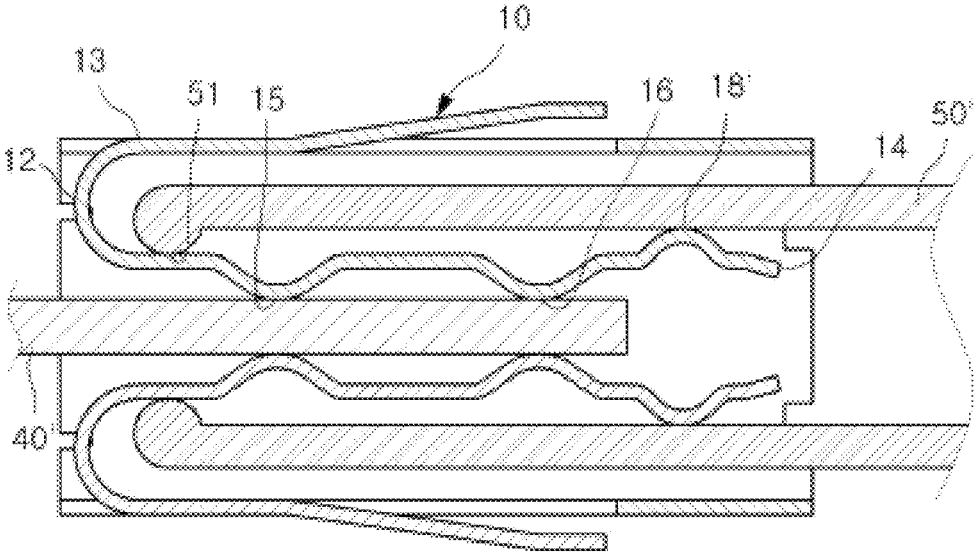
FIG. 7 is another partial section view of the coupling terminal unit shown in FIG. 6, when the connection body and the connection terminal unit are fitted into the coupling terminal unit.

Referring to FIG. 7, the connection body terminal unit 50' is inserted into the spaces defined between the fixed ends 13 and the corresponding free ends 14 of the coupling terminal unit 10.

At this time, the front contact points 51, which are formed at the front ends of the connection body terminal unit 50' such that the front contact points 51 protrude inward of the coupling terminal unit 10, come into contact with surfaces adjacent to bent portions 12 of the coupling terminal unit 10. In addition, rear ends of the connection body terminal unit 50' come into contact with the outside contact points 18' formed at the free ends 14 of the coupling terminal unit 10 such that the outside contact points 18' protrude outward of the coupling terminal unit 10. Therefore, contact is achieved between each of the upper and lower coupling terminal parts of the coupling terminal unit 10 and the connection body terminal unit 50' at two or more contact points.

Also, a connection terminal unit 40' is inserted into the coupling terminal unit 10 through a space defined between the bent portions 12 of the coupling terminal unit 10. At this time, the connection terminal unit 40' comes into contact with the first and second inside contact points 15 and 16 formed at each of the upper and lower coupling terminal parts of the coupling terminal unit 10. Therefore, contact is achieved between each of the upper and lower coupling terminal parts of the coupling terminal unit 10 and the connection terminal unit 40' at two or more contact points.

As a result, the connection terminal unit 40' and the connection body terminal unit 50' are electrically connected to each other through the coupling terminal unit 10 such that contact is achieved between each of the upper and lower coupling terminal parts of the coupling terminal unit 10 and the connection terminal unit 40' at two or more contact points and contact is achieved between each of the upper and lower coupling terminal parts of the coupling terminal unit 10 and the connection body terminal unit 50' at two or more contact points.

According to the invention, contact is achieved between each of the upper and lower coupling terminal parts of the coupling terminal unit 10 and the connection terminal unit 40 at two or more contact points. Therefore, the invention has the effect of effectively dispersing heat generated from the contact points during electrical connection between the coupling terminal unit 10 and the connection terminal unit 40. In the same manner, contact is achieved between each of the upper and lower coupling terminal parts of the coupling terminal unit 10 and the connection body terminal unit 50 at two or more contact points. Therefore, the invention has the effect of effectively dispersing heat generated from the contact points during electrical connection between the coupling terminal unit 10 and the connection body terminal unit 50.

As described above, heat generated from the contact points is dispersed. Therefore, the present invention has the effect of preventing sparking at the contact points due to excessive heat generation, thereby eliminating a risk of explosion.

Also, the distance between the inside contact points of the upper and lower coupling terminal parts of the coupling terminal unit positioned at the front parts thereof is equal to the distance between the inside contact points of the upper and lower coupling terminal parts of the coupling terminal unit positioned at the rear parts thereof. Therefore, the invention has the effect of minimizing the insertion force necessary to insert the connection terminal unit into the coupling terminal unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A connector terminal comprising:

a coupling terminal unit having an upper coupling terminal part symmetrically arranged with a lower coupling terminal part, wherein each of the upper and lower coupling terminal parts includes:

a fixed end;

a movable free end positioned opposite the fixed end and having a plurality of contact points with a plurality of inside contact points formed at each of the upper and lower coupling terminal parts;

and a bent portion positioned between the fixed end and the movable free end and disposed along a front side of each of the upper and lower coupling terminal parts; and a connection body terminal unit received in the coupling terminal unit and having a front contact point positioned between the fixed end and the plurality of inside contact points and protruding inward of the coupling terminal unit.

2. The connector terminal according to claim 1, wherein the plurality of inside contact points protrude inward of the coupling terminal unit.

3. The connector terminal according to claim 2, wherein the plurality of inside contact points positioned on the upper coupling terminal part protrude toward the plurality of inside contact points positioned on the lower coupling terminal part.

4. The connector terminal according to claim 3, wherein the plurality of contact points further include an outside contact point disposed along each of the upper and lower coupling terminal parts of the coupling terminal unit such that the outside contact point protrudes outward of the coupling terminal unit.

5. The connector terminal according to claim 3, wherein the plurality of inside contact points of the upper and lower coupling terminal parts are equally spaced apart from each other.

6. The connector terminal according to claim 4, wherein the outside contact point positioned on the upper coupling terminal part protrudes away from the outside contact point positioned on the lower coupling terminal part.

7. The connector terminal according to claim 6, wherein the outside contact point is positioned between the plurality of inside contact points.

8. The connector terminal according to claim 7, wherein the plurality of contact points further include a second outside contact point disposed along each of the upper and lower coupling terminal parts of the coupling terminal unit such that the second outside contact point protrudes outward of the coupling terminal unit.

9. The connector terminal according to claim 8, wherein one of the plurality of inside contact points is positioned between the outside contact point and the second outside contact point.

10. A connector terminal comprising:

a coupling terminal unit having an upper coupling terminal part symmetrically arranged with a lower coupling terminal part, wherein each of the upper and lower coupling terminal parts includes:

a fixed end;

a movable free end positioned opposite the fixed end and having a plurality of inside contact points, a plurality of outside contact points such that one of the plurality of contact points is positioned between the plurality of inside contact points, a bent portion positioned between the fixed end and the movable free end and disposed along a front side of each of the upper and lower coupling terminal parts; and a connection body terminal unit received in the coupling terminal unit and having a front contact point positioned between the fixed end and the plurality of inside contact points and protruding inward of the coupling terminal unit.

11. A connector terminal comprising:

a coupling terminal unit having an upper coupling terminal part symmetrically arranged with a lower coupling terminal part, wherein each of the upper and lower coupling terminal parts includes:

a fixed end;

a movable free end positioned opposite the fixed end and having a pair of inside contact points and an outside contact point adjacent one of the pair of inside contact points; and a bent portion positioned between the fixed end and the movable free end and disposed along a front side of each of the upper and lower coupling terminal parts, and a connection body terminal unit received in the coupling terminal unit and having a front contact point positioned between the fixed end and the pair of inside contact points and protruding inward of the coupling terminal unit.

* * * * *